US010961104B2

(12) United States Patent
Perkins et al.

(10) Patent No.: US 10,961,104 B2
(45) Date of Patent: Mar. 30, 2021

(54) DISPENSE TAP WITH INTEGRAL INFUSION

(71) Applicant: FLOW CONTROL LLC, Beverly, MA (US)

(72) Inventors: Bernard L. Perkins, Orange, CA (US); Humberto V. Meza, Trabuco Canyon, CA (US)

(73) Assignee: FLOW CONTROL LLC, Beverly, MA (US)

( * ) Notice: Subject to any disclaimer, the term of this patent is extended or adjusted under 35 U.S.C. 154(b) by 225 days.

(21) Appl. No.: 16/031,331

(22) Filed: Jul. 10, 2018

(65) Prior Publication Data

US 2019/0135606 A1 May 9, 2019

Related U.S. Application Data

(60) Provisional application No. 62/530,453, filed on Jul. 10, 2017.

(51) Int. Cl.
*B67D 1/00* (2006.01)
*B67D 1/12* (2006.01)
(Continued)

(52) U.S. Cl.
CPC ..... *B67D 1/0071* (2013.01); *B01F 3/00* (2013.01); *B01F 3/04* (2013.01); *B01F 15/00* (2013.01);
(Continued)

(58) Field of Classification Search
CPC .... B01F 3/00; B01F 3/04; B01F 15/00; B01F 15/02; B67D 1/0071; B67D 1/00; B67D 1/08; B67D 1/12; B67D 1/1277
(Continued)

(56) References Cited

U.S. PATENT DOCUMENTS 3,347,421 A 10/1967 Yingst et al.
3,761,066 A * 9/1973 Wheeler ..... B01F 5/0694 261/78.2
(Continued)

FOREIGN PATENT DOCUMENTS

GB 2172578 B 7/1988
GB 2453209 A 4/2009
(Continued)

OTHER PUBLICATIONS

"Leland CO2 Picnic Tap," Keg Works, kegworks.com, Item#: 50500, accessed, Jul. 2017. https://www.kegworks.com/leland-co2-picnic-tap.
(Continued)

*Primary Examiner* — Charles S Bushey
(74) *Attorney, Agent, or Firm* — Ware, Fressola, Maguire & Barber LLP

(57) ABSTRACT

A dispense tap with integral gas/liquid infusion for dispensing a beverage at a given dispensing point inside a restaurant, a coffee shop, a bar, or a convenience store, features a mixing chamber having at least one gas input port configured to receive at least one incoming gas stream; at least one liquid input port configured to receive at least one incoming liquid or concentrate stream; and an infuser configured to mix the at least one incoming gas stream and the at least one incoming liquid or concentrate stream at the given dispensing point within the dispensing tap, and provide a mixing chamber stream containing a gas infused liquid mixture of the at least one incoming gas stream and the at least one incoming liquid or concentrate stream for dispensing as a beverage. The degree of absorption of the at least one incoming gas stream and the at least one incoming liquid or concentrate stream in the gas infused liquid mixture depends at least in part on sensed gas, liquid or concentrate pressure characteristics of one or more of the at least one incoming
(Continued)

Integrated Infusion Device gas stream received by the infuser, the at least one incoming liquid or concentrate stream received by the infuser, or the gas infused liquid mixture provided from the infuser.

17 Claims, 10 Drawing Sheets

(51) Int. Cl.

| | |
|---|---|
| ***B01F 3/00*** | (2006.01) |
| ***B01F 15/00*** | (2006.01) |
| ***B01F 3/04*** | (2006.01) |
| ***B67D 1/08*** | (2006.01) |
| ***B01F 15/02*** | (2006.01) |

(52) U.S. Cl.
CPC ..... *B01F 15/02* (2013.01); *B67D 1/00* (2013.01); *B67D 1/08* (2013.01); *B67D 1/12* (2013.01); *B67D 1/1277* (2013.01)

(58) Field of Classification Search
USPC ..... 261/24, 26, 27, 64.3, DIG. 7
See application file for complete search history.

(56) References Cited

U.S. PATENT DOCUMENTS

| | | | | |
|---|---|---|---|---|
| 3,830,405 | A | 8/1974 | Jaeger | |
| 4,932,561 | A | 6/1990 | Boxall | |
| 5,029,733 | A * | 7/1991 | Hedderick | B67D 1/0004 137/170.1 |
| 5,033,651 | A | 7/1991 | Whigham et al. | |
| 5,443,186 | A | 8/1995 | Grill | |
| 5,494,193 | A | 2/1996 | Kirschner et al. | |
| 5,592,867 | A | 1/1997 | Walsh | |
| 5,842,600 | A * | 12/1998 | Singleterry | A23L 2/54 222/1 |
| 5,984,142 | A | 11/1999 | Castaldi | |
| 6,286,721 | B1 | 9/2001 | Pellegrini | |
| 7,080,525 | B2 | 7/2006 | McCann et al. | |
| 8,177,197 | B1 * | 5/2012 | Ergican | B01F 5/0615 261/78.2 |
| 8,365,959 | B2 | 2/2013 | Tavolazzi | |
| 8,840,092 | B2 * | 9/2014 | Kumar | B01F 3/04737 261/26 |
| 8,857,797 | B2 * | 10/2014 | Kumar | A23L 2/54 261/26 |
| 8,882,084 | B2 * | 11/2014 | Malagi | A23L 2/54 261/26 |
| 9,033,315 | B2 | 5/2015 | Phillips et al. | |
| 9,085,451 | B2 | 7/2015 | Santy | |
| 9,260,283 | B2 | 2/2016 | Minica et al. | |
| 9,499,390 | B1 | 11/2016 | Newton et al. | |
| 9,656,849 | B2 | 5/2017 | Hawken | |
| 10,470,483 | B1 * | 11/2019 | Lisiecki | B01F 3/04787 |
| 2006/0288874 | A1 * | 12/2006 | Ziesel | B67D 1/0058 99/279 |
| 2009/0114680 | A1 | 5/2009 | Williams et al. | |
| 2010/0133708 | A1 * | 6/2010 | Fischer | B01F 3/0446 261/94 |
| 2012/0138155 | A1 | 6/2012 | Brensing et al. | |
| 2013/0330917 | A1 | 12/2013 | Homan et al. | |
| 2014/0346192 | A1 | 11/2014 | Santy et al. | |
| 2016/0297665 | A1 * | 10/2016 | Petermann | B67D 1/0888 |
| 2016/0318747 | A1 | 11/2016 | Peirsman et al. | |
| 2017/0055552 | A1 | 3/2017 | Giardino et al. | |
| 2017/0164643 | A1 | 6/2017 | Lundberg et al. | |
| 2018/0280896 | A1 * | 10/2018 | Perkins | B01F 3/04737 |

FOREIGN PATENT DOCUMENTS

| | | | |
|---|---|---|---|
| GB | 2456324 | A | 7/2009 |
| WO | 9902449 | A1 | 1/1999 |
| WO | 2007087611 | A1 | 8/2007 |
| WO | 2014003905 | A1 | 1/2014 |
| WO | 2017093910 | A1 | 6/2017 |

OTHER PUBLICATIONS

"SIDEBAR TRIO®, Liquor on Tap and Draft Beer," SideBar® Beverage Systems, sidebarbeverage.com, Product Code: TRIO-6500, accessed, Jul. 2017. http://www.sidebarbeverage.com/liquor-dispenser-beer-tower-double-tap-keg-wet-bar-faucet.

* cited by examiner

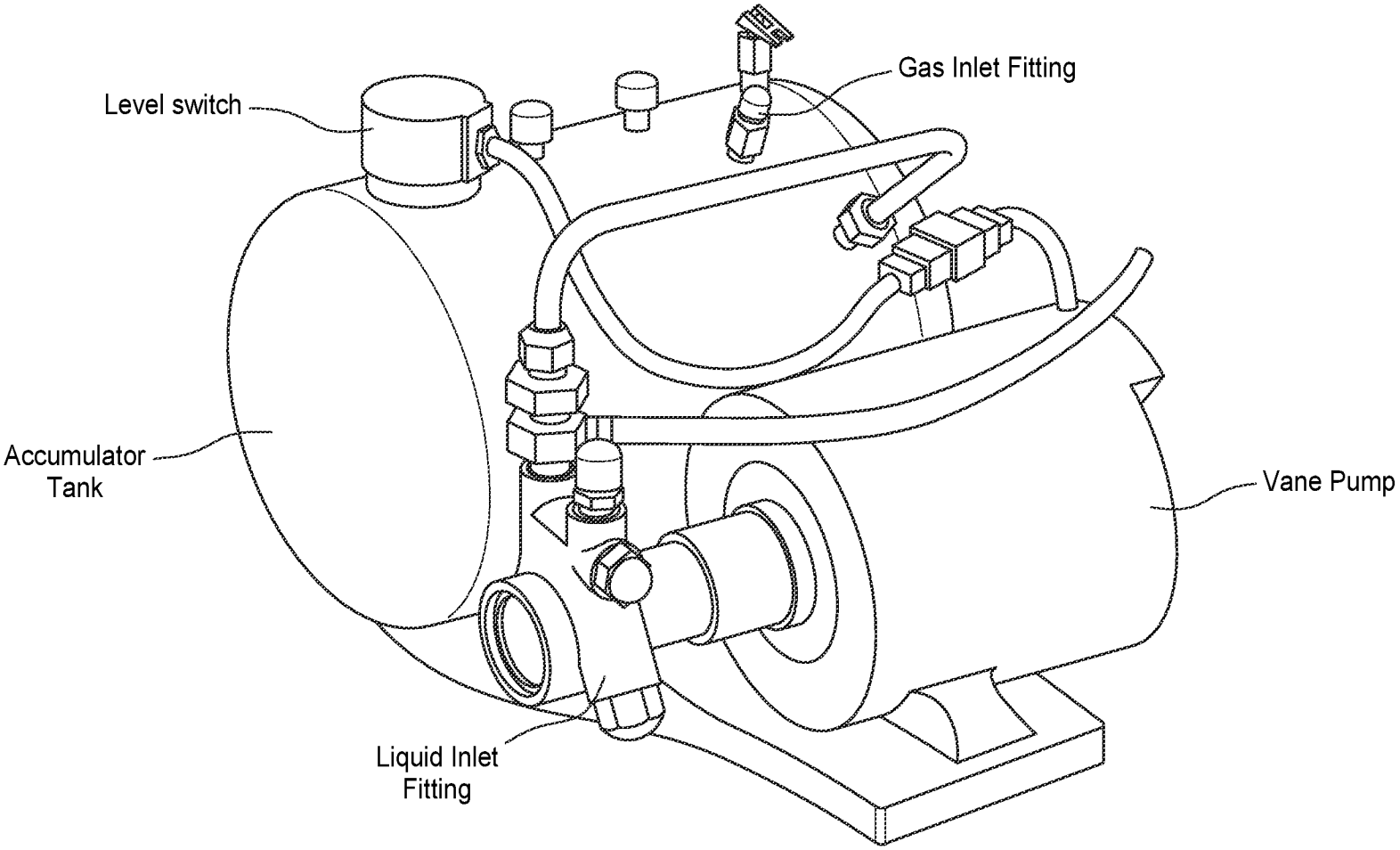
*FIG. 1*: Standard Beverage Carbonator (Prior Art)

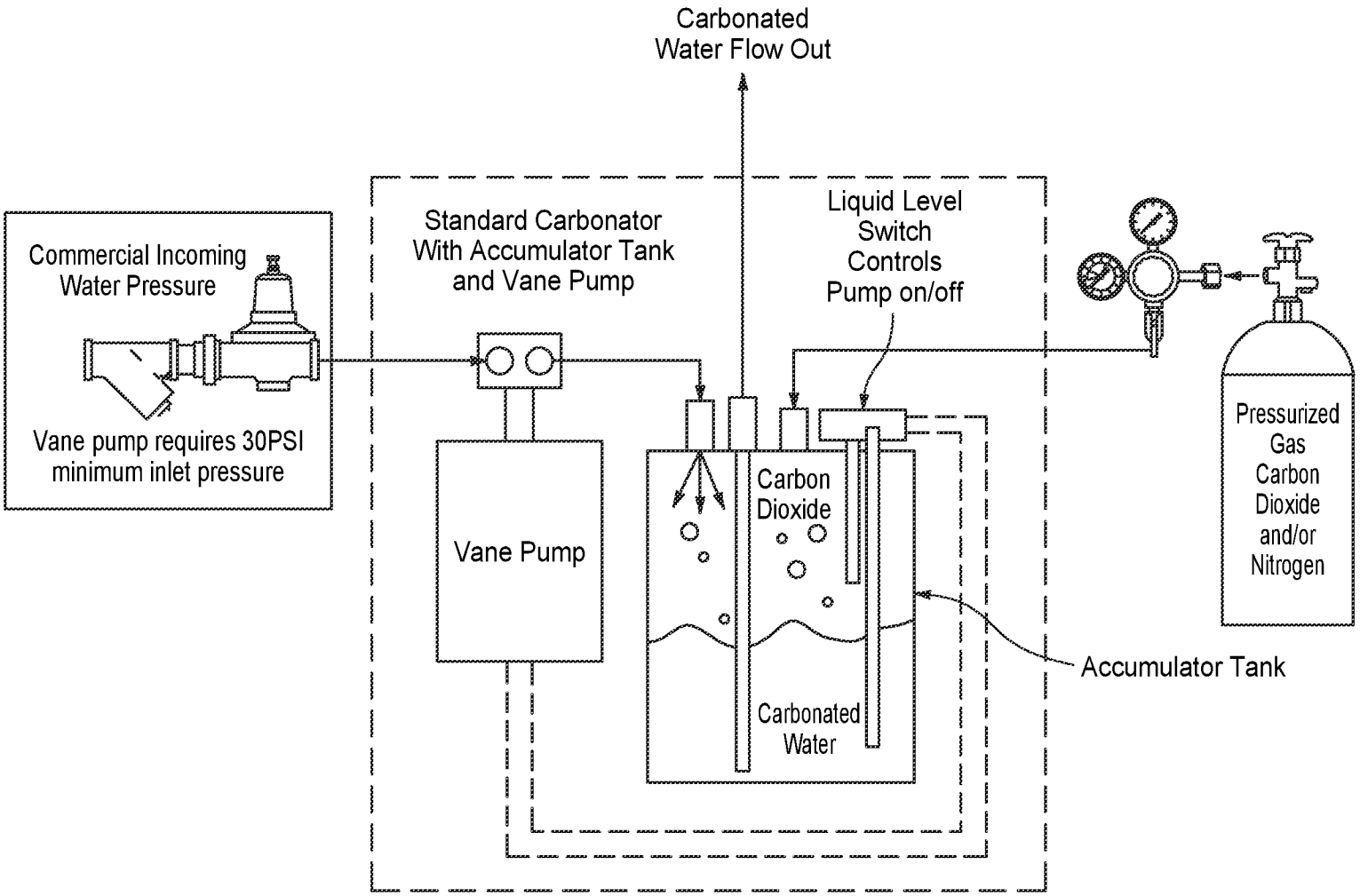
*FIG. 2*: Carbonator System Diagram (Prior Art)

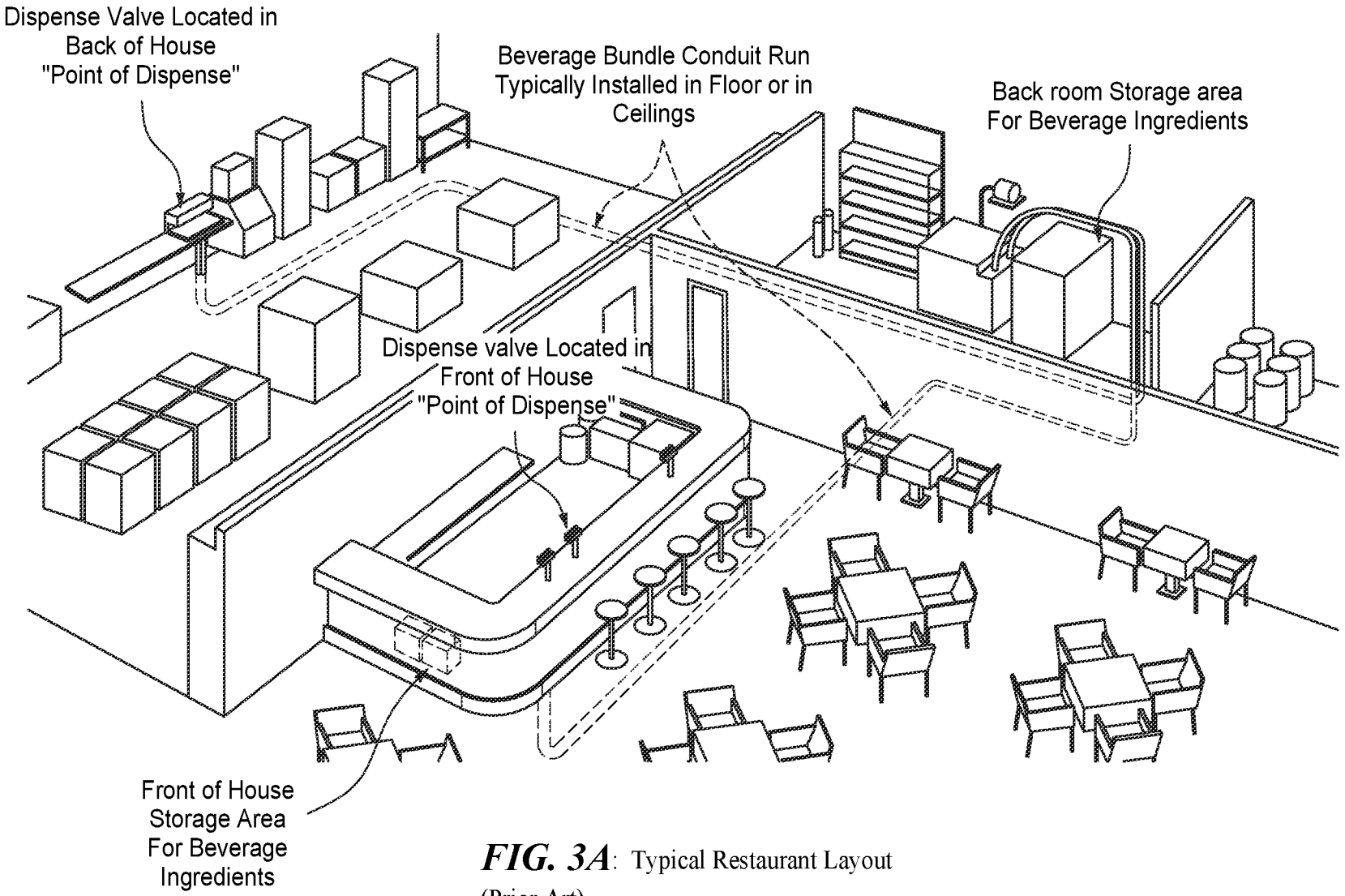
*FIG. 3A*: Typical Restaurant Layout (Prior Art)

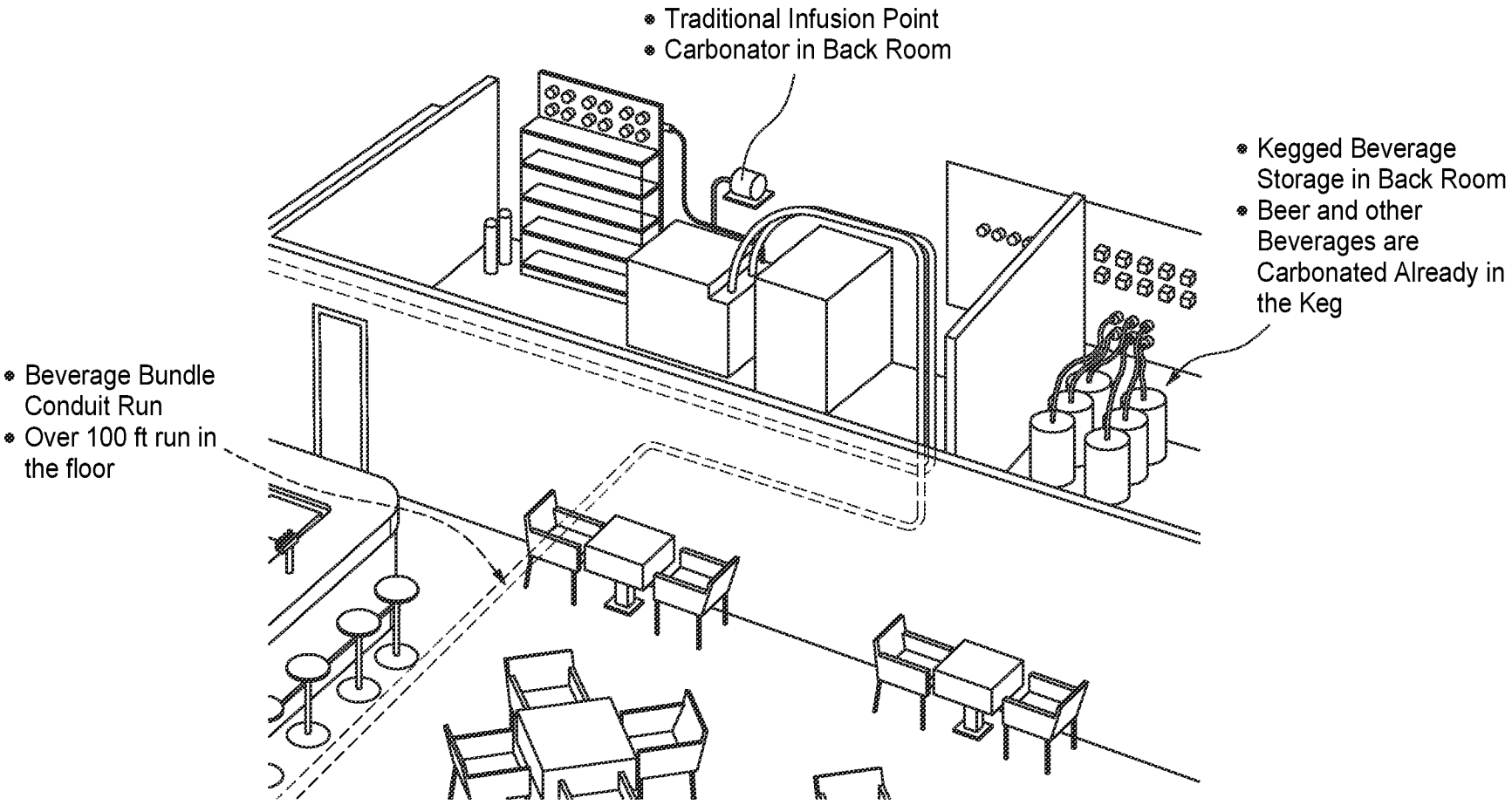
*FIG. 3B*: Typical Restaurant Layout
(Prior Art)

*FIG. 4*: Examples of a typical beverage Dispense Tap

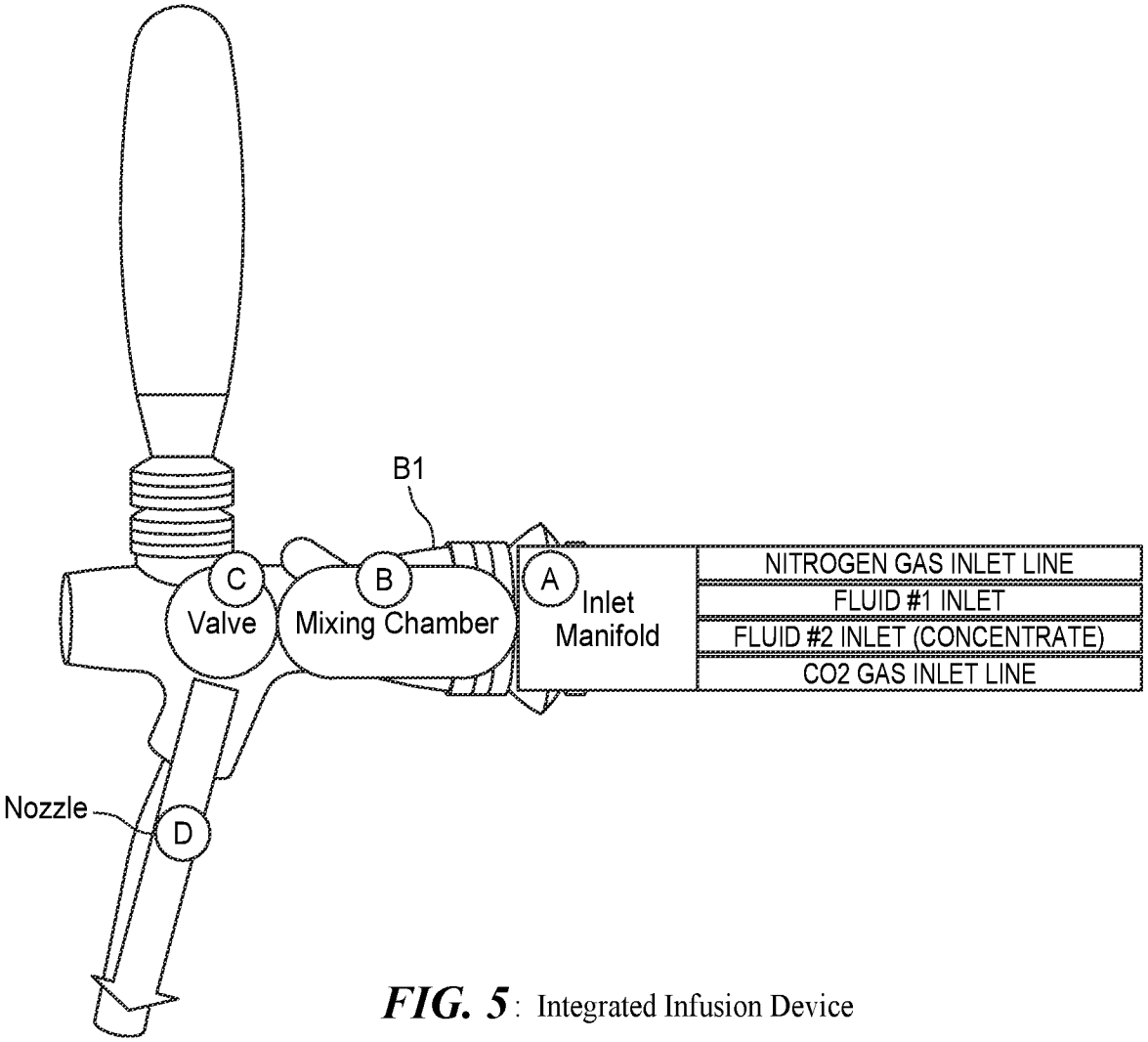
*FIG. 5*: Integrated Infusion Device

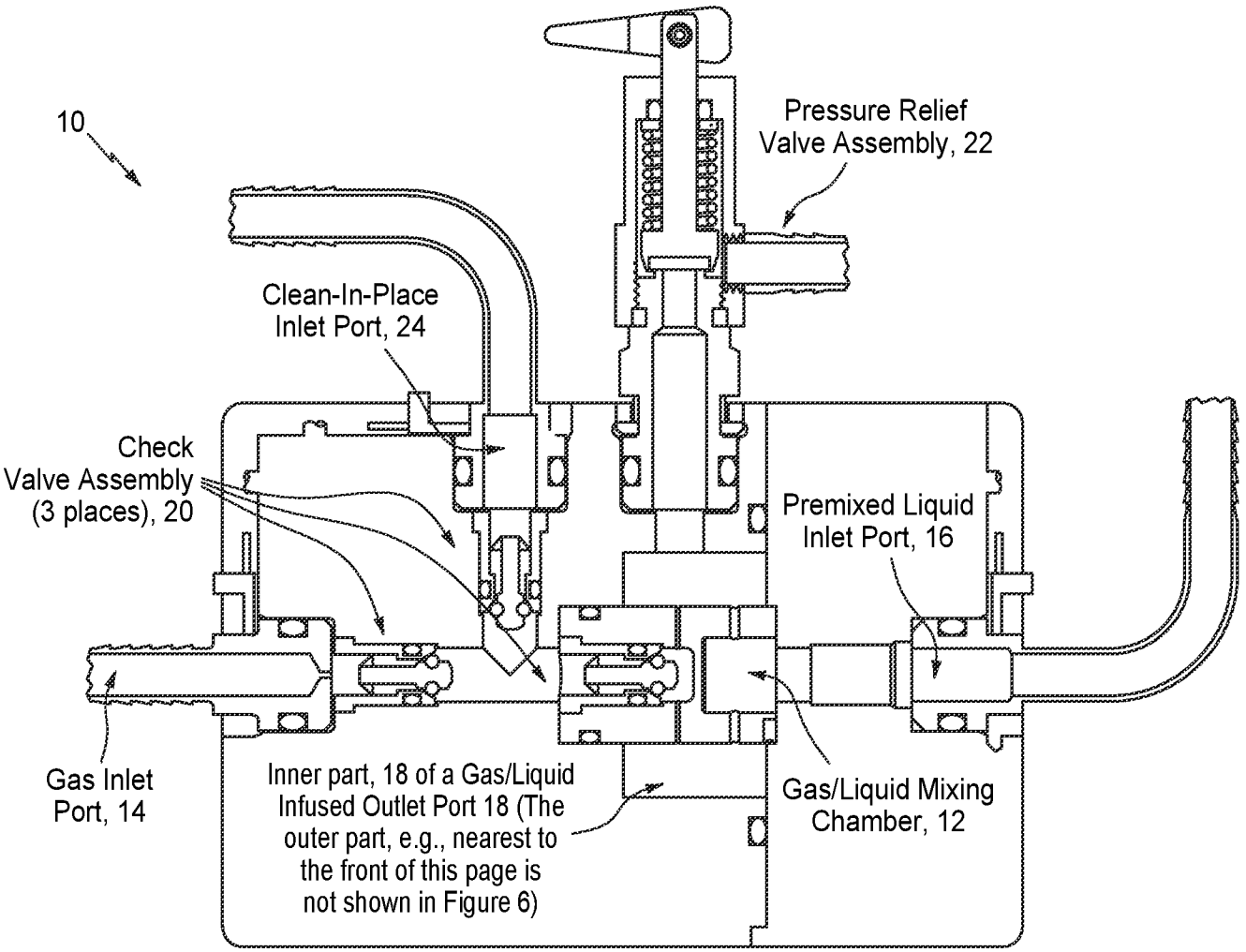
*FIG. 6*: Gas Liquid Absorption Device (GLAD)

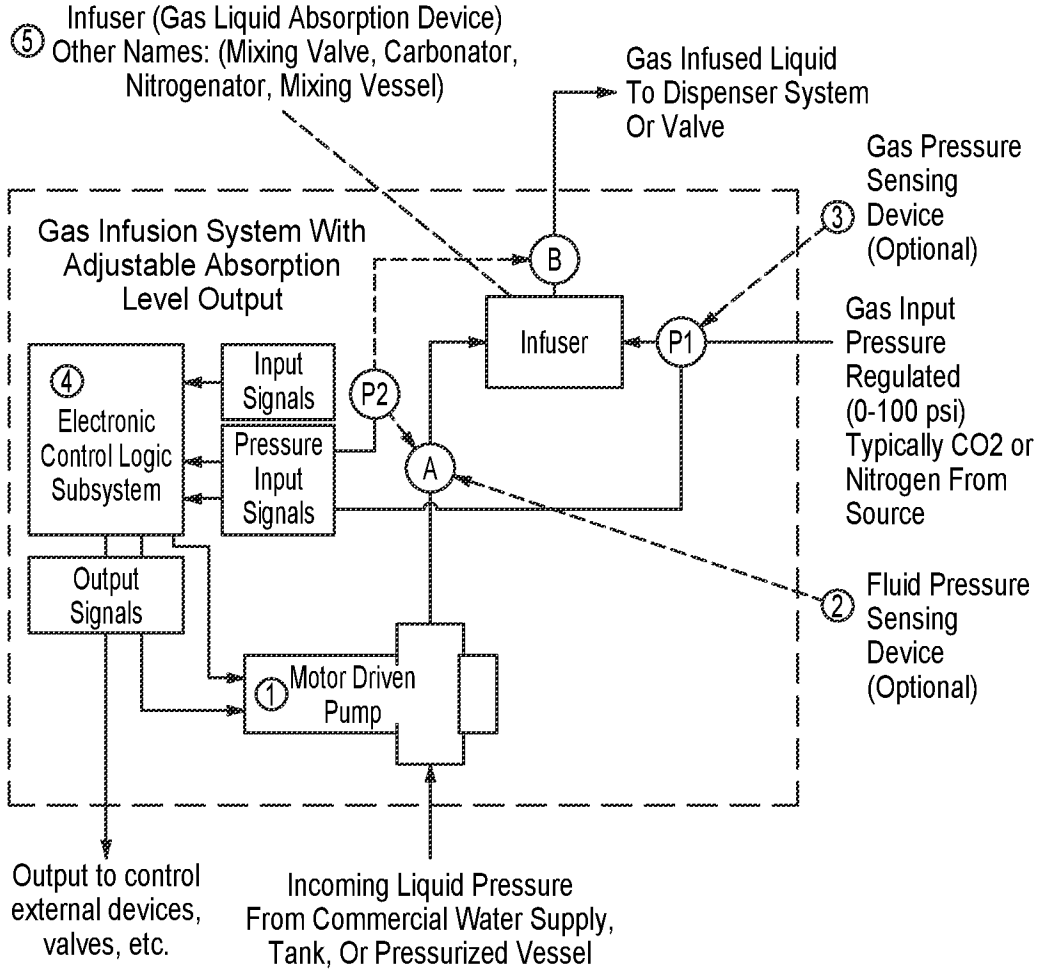
*FIG. 7*: Gas Liquid Infusion System with Adjustable Absorption Level

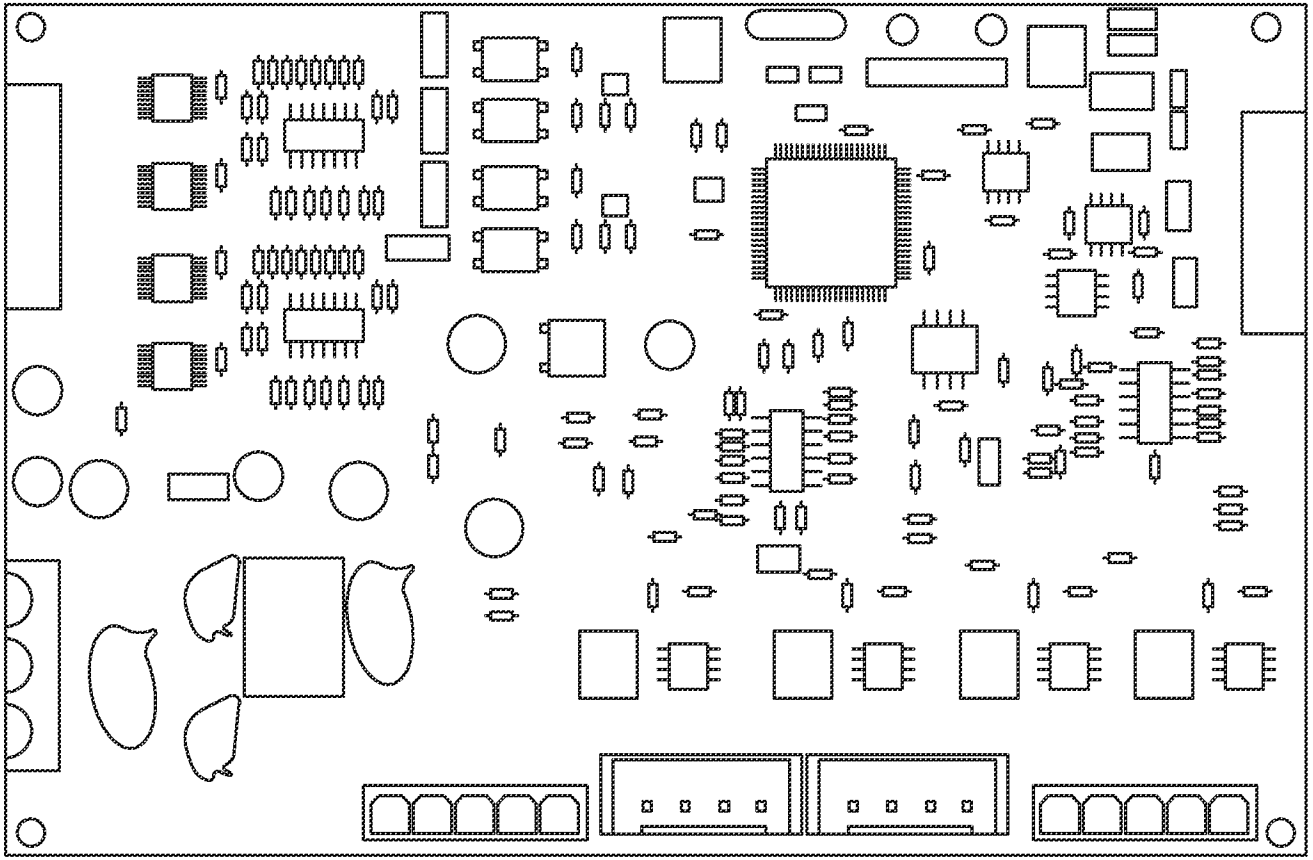
*FIG. 8*: REV OEM Controller for Gas Liquid Infusion System

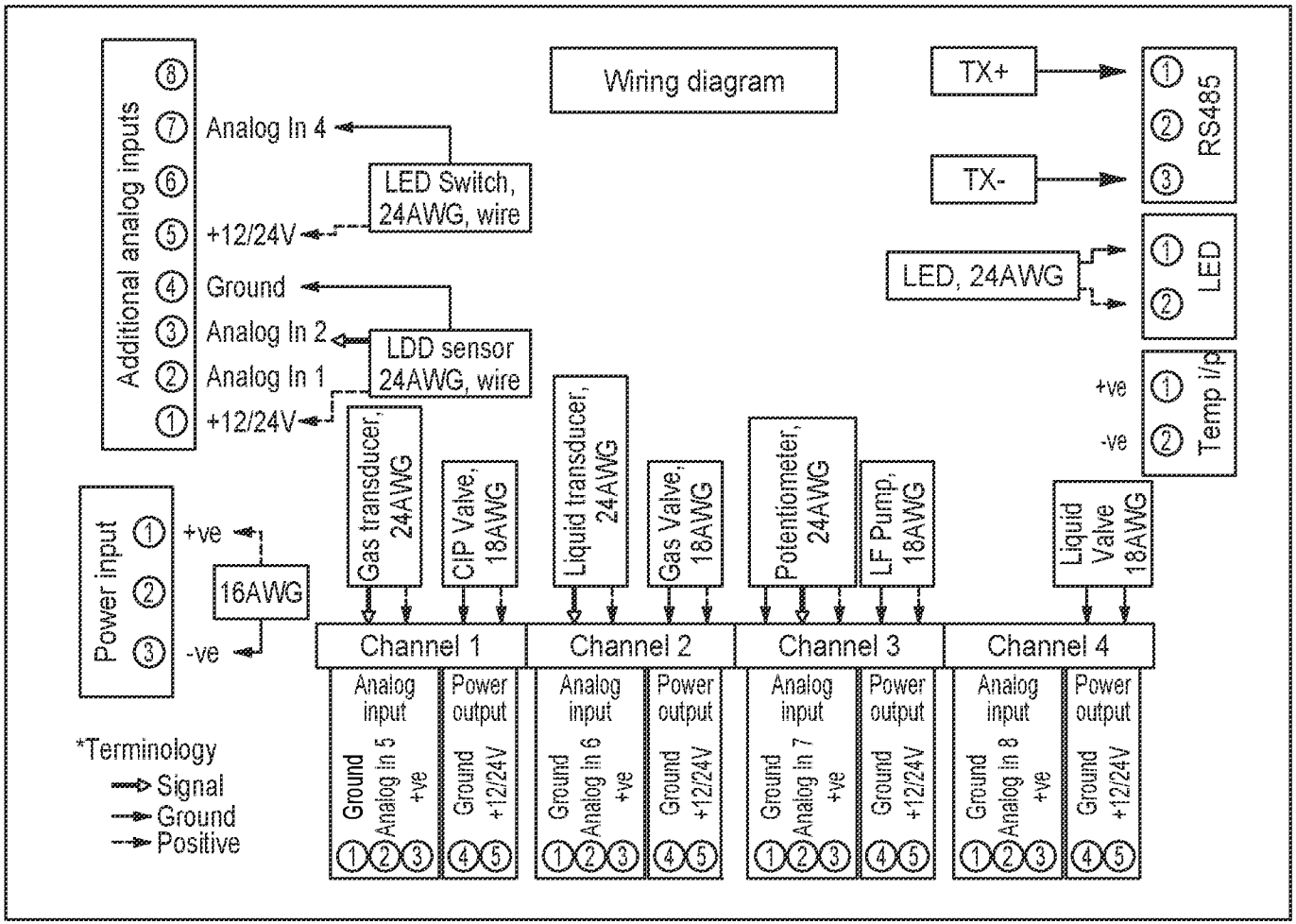
*FIG. 9*: REV OEM Controller wiring diagram

DISPENSE TAP WITH INTEGRAL INFUSION

CROSS-REFERENCE TO RELATED APPLICATION

This application claims benefit to provisional patent application Ser. No. 62/530,453, filed 10 Jul. 2017, which is hereby incorporated by reference in its entirety.

BACKGROUND OF THE INVENTION

1. Field of the Invention

The present invention relates to a system for infusing a liquid with a gas, e.g., for beverage applications.

2. Brief Description of Related Art

1) Water Carbonator System with a Tank for Beverage Applications:

Theory of operation: FIGS. 1 and 2 show a standard beverage water carbonator that is a device designed to dissolve carbon dioxide gas (CO2) and/or Nitrogen gas into water, producing infused water. CO2 gas is delivered through a regulator to the carbonator tank gas inlet fitting. Simultaneously, plain water is pumped into the tank from a vane pump which is fed from a commercial water source. The gas, under pressure, partially dissolves in the water and the result is carbonated and/or nitrogenated water. Some systems include chilling the water before, during, and/or after passing through the carbonator. The output carbonation level produced is constant based on the equilibrium of the gas/liquid established at the temperature and pressure conditions of the system.

2) Inline Carbonator Devices Such as the Assignee's Carbjet (U.S. Pat. No. 9,033,315 B2):

This and similar inline devices enable mixing of liquid and gas in a flow through an inline mixing chamber as contrasted with the accumulator tank in the first example above. The principles of operation are similar to the standard carbonator system, but there is no reservoir tank so the carbonation/infusion of the gas into liquid happens on demand as the dispense valve is opened. The gas and liquid streams are combined inline at some point upstream of the dispense valve. Inline devices are often less efficient than traditional carbonator tank designs which lead to excessive breakout when higher levels of infusion are desired. U.S. Pat. No. 9,033,315 B2, entitled "Adjustable in-line on demand carbonation chamber for beverage applications," includes a carbonation chamber in FIGS. 1-2 thereof that is configured to carbonate a liquid and a gas, which is hereby incorporated by reference in its entirety.

Some of the Shortcomings of the Above Mentioned Devices

In most restaurants, coffee shops, bars, and convenience stores, beverage ingredients are delivered to the point of dispense from a backroom storage area or walk-in cooler to the front of house where dispensing takes place from beverage dispense taps like that shown in FIG. 4. FIGS. 3A and 3B show a typical facility representation, in which fluid delivery is accomplished via beverage dispense pumps or pressurized vessels, and gas is delivered to the carbonator tank or inline infuser via regulated pressurized supply from a gas cylinder, a gas generator, or other blended gas source. FIGS. 4A and 4B show examples of typical beverage dispense taps that are located remote from the backroom storage area or walk-in cooler shown in FIGS. 3A and 3B.

Current technology carbonator devices and inline infusion devices both perform the task of mixing the beverage ingredient fluid and gas streams together at some point in the system upstream of the point of dispense. Typically, this occurs in a carbonator system in the back storage area or remote under counter.

When the beverage is infused with gas (carbonated/nitrogenated) upstream of the dispense point, such as in a carbonator in the back room, or a beer keg in the cold storage (see FIGS. 3A and 3B), the infused liquid and gas mixture will separate in the tubing due to an increase in temperature, or a loss in pressure, or other environmental or system disturbance occurring along the hose conduit. This separation of gas from the fluid mixture can occur anywhere along the run length for a variety of reasons such as: insufficient cooling, localized heat from nearby equipment, etc. This separation of gas from the fluid leads to pockets of gas forming in the beverage line. As they rise in solution, these gas pockets of gas accumulate in high points in the plumbing system and form a large gas bubble or slug. The gas slugs are eventually delivered and dispensed through the dispense valve nozzle. As this gas bubble or slug exits the dispense nozzle, it increases the velocity of the fluid being dispensed from the nozzle creating a turbulent and undesirable splashing of the beverage from the dispense valve. In addition, the increased velocity and subsequent gap in flow create a forceful entry of fluid into the cup, which leads to additional spillage of the beverage that was already in the cup. This creates a mess, negatively affects beverage quality, creates product waste, and creates a negative customer perception.

There is a need in the industry for a better way to infuse gas and liquid for dispensing beverages in restaurants, coffee shops, bars, and convenience stores, etc.

SUMMARY OF THE PRESENT INVENTION

According to some embodiments, the present invention may include, or take the form of, a beverage tap infusion device that overcomes the application challenges and limitations of the above prior art devices, e.g., by performing the infusion of gas into fluid within the dispense valve. By locating the infusion at the point of dispense, the separation of gas from fluid does not occur along the beverage conduit run. The infusion process within the beverage tap occurs by controlling the differential pressure of the input streams, and the pressure at which the infusion occurs. A simple representation of the device is shown in FIG. 5 below. These devices come in various styles, sizes, and can include flow control valves, as well as standard electronic controlled soda dispenser valves as well.

Particular Embodiments

A Dispense Tap

By way of example, and according to some embodiments, the present invention may include, or take the form of, a dispense tap with integral gas/liquid infusion for dispensing a beverage at a given dispensing point inside a restaurant, a coffee shop, a bar, or a convenience store, featuring a mixing chamber having

- at least one gas input port configured to receive at least one incoming gas stream;
- at least one liquid input port configured to receive at least one incoming liquid or concentrate stream; and an infuser configured to mix the at least one incoming gas stream and the at least one incoming liquid or concentrate stream at the given dispensing point within the dispensing tap, and provide a mixing chamber stream containing a gas infused liquid mixture of the at least one incoming gas stream and the at least one incoming liquid or concentrate stream for dispensing as a beverage, where the degree of absorption of the at least one incoming gas stream and the at least one incoming liquid or concentrate stream in the gas infused liquid mixture depends at least in part on sensed gas, liquid or concentrate pressure characteristics of one or more of the at least one incoming gas stream received by the infuser, the at least one incoming liquid or concentrate stream received by the infuser, or the gas infused liquid mixture provided from the infuser.

In the present invention, the dispense tap with integral gas/liquid infusion is configured to infuse the gas and liquid in the mixing chamber at the given dispensing point inside the restaurant, the coffee shop, the bar, or the convenience store, not in some backroom location or at some other remote location of the restaurant, the coffee shop, the bar, or the convenience store away from the dispense tap, as was done in the prior art set forth above.

By way of further example, the dispense tap with integral infusion may also include one or more of the following features:

According to some embodiments, the degree of absorption may depend at least in part on the sensed gas, liquid or concentrate pressure characteristics of two or more of the at least one incoming gas stream received by the infuser, the at least one incoming liquid or concentrate stream received by the infuser, or the gas infused liquid mixture provided from the infuser.

According to some embodiments, the degree of absorption may depend on the sensed gas, liquid or concentrate pressure characteristics of all of the at least one incoming gas stream received by the infuser, the at least one incoming liquid or concentrate stream received by the infuser, and the gas infused liquid mixture provided from the infuser.

According to some embodiments, the dispense tap may form part of a gas liquid infusion system having an adjustable absorption level output having gas and liquid pressure sensors, an electronic control logic subsystem and a motor driven pump. The gas and liquid pressure sensors may be configured to respond to gas, liquid or concentrate pressures of one or more of the at least one incoming gas stream, the at least one incoming liquid or concentrate stream, and the gas infused liquid mixture, and provide gas, liquid or concentrate pressure sensor signals containing information about the gas, liquid or concentrate pressures sensed. The electronic control logic subsystem may be configured to respond to the gas, liquid or concentrate pressure sensor signals, and provide pump control signals. The motor driven pump may be configured to respond to the pump control signals, and pump the at least one incoming liquid or concentrate stream, based upon the pump control signals received.

According to some embodiments, the dispense tap may include an inlet manifold having: at least one gas inlet line configured to receive the at least one incoming gas stream and provide the at least one incoming gas stream to the at least one gas input port; and at least one liquid inlet line configured to receive the at least one incoming liquid or concentrate stream and provide the at least one incoming liquid or concentrate stream to the at least one liquid input port.

According to some embodiments, the inlet manifold may include gas and liquid pressure sensors configured to respond to gas and liquid pressures of one or more of the at least one incoming gas stream, the at least one incoming liquid stream and the gas infused liquid mixture, and provide gas and liquid pressure sensor signals containing information about the gas and liquid pressures sensed.

According to some embodiments, the dispense tap may include an inlet manifold having: a nitrogen gas inlet line configured to receive a nitrogen gas stream; a liquid inlet line configured to receive a liquid stream; a concentrate inlet line configured to receive a concentrate stream; and a CO2 gas inlet line configured to receive a CO2 gas stream.

According to some embodiments, the nitrogen gas inlet line may be configured to provide the nitrogen gas stream to the at least one gas input port; the liquid inlet line may be configured to provide the liquid stream to the at least one liquid input port; the concentrate inlet line may be configured to provide the concentrate stream to the at least one gas input port; and the CO2 gas inlet line may be configured to provide the CO2 gas stream to the to the at least one liquid input port.

According to some embodiments, the dispense tap may include:

a handle or electronic solenoid configured to move between a dispense position and a closed position;

a valve configured to respond to movement of the handle or electronic solenoid from the closed position to the dispense position and provide the infused mixture from the mixing chamber; and a nozzle configured to receive the infused mixture from the valve, and dispense the infused mixture from the dispense tap.

According to some embodiments, the mixing chamber may include a mixing chamber housing configured to receive and contain at least the infuser of the mixing chamber.

According to some embodiments, the mixing chamber may include a mixing chamber output port configured to provide the mixing chamber stream for dispensing as the beverage.

The at least one gas input port may include a CO2 input port configured to receive a CO2 gas stream; and a nitrogen input port configured to receive a nitrogen gas stream.

According to some embodiments, the at least one liquid input port may include a liquid input port configured to receive a liquid stream; and a concentrate input port configured to receive a concentrate stream.

According to some embodiments, the dispense tap may form part of a gas liquid absorption device having a gas/liquid mixing chamber with the infuser.

A Gas Liquid Infusion System

According to some embodiments, the present invention may include, or take the form of, a gas liquid infusion system featuring a dispense tap with integral infusion for dispensing a beverage at a given dispensing point inside a restaurant, a coffee shop, a bar, or a convenience store, having a mixing chamber that includes: at least one gas input port configured to receive at least one incoming gas stream; at least one liquid input port configured to receive at least one incoming liquid or concentrate stream; and an infuser configured to mix the at least one incoming gas stream and the at least one incoming liquid or concentrate stream at the given dispensing point within the dispensing tap, and provide a mixing chamber stream containing a gas infused liquid mixture of the at least one incoming gas stream and the at least one incoming liquid or concentrate stream for dispensing as a beverage, where the degree of absorption of the at least one incoming gas stream and the at least one incoming liquid or concentrate stream in the gas infused liquid mixture depends at least in part on sensed gas, liquid or concentrate pressure characteristics of one or more of the at least one incoming gas stream received by the infuser, the at least one incoming liquid or concentrate stream received by the infuser, or the gas infused liquid mixture provided from the infuser.

The gas liquid infusion system may also include one or more of the features set forth herein, including the features set forth in relation to the dispense tap above.

BRIEF DESCRIPTION OF THE DRAWING

The drawing, which is not necessarily drawn to scale, includes the following Figures:

FIG. 1 shows a standard beverage carbonator that is known in the art.

FIG. 2 is a diagram of a beverage carbonator that is known in the art.

FIG. 3A shows a typical restaurant layout that is known in the art.

FIG. 3B shows an exploded view of part of the typical restaurant layout shown in FIG. 3A.

FIG. 5 shows a block diagram of an integrated infusion device or system (aka as "a dispense tap with integral infusion") having an inlet manifold, a mixing chamber, a valve and a nozzle, according to some embodiments of the present invention.

FIG. 6 shows a cross-sectional view of an example of a gas/liquid absorption device (GLAD) that may be configured in, or form part of, the mixing chamber of the integrated infusion device shown in FIG. 5, according to some embodiments of the present invention.

FIG. 7 shows a block diagram of an example of a gas liquid infusion system with adjustable absorption level, e.g., having an infuser that may be configured in, or form part of, the integrated infusion device, according to some embodiments of the present invention.

FIG. 8 shows an example of a REV OEM controller for a gas/liquid infusion system, according to some embodiments of the present invention.

FIG. 9 shows an example of a REV OEM Controller wiring diagram for the Gas/Liquid Infusion System, according to some embodiments of the present invention.

Similar parts or components in Figures are labeled with similar reference numerals and labels for consistency. Every lead line and associated reference label for every element is not included in every Figure of the drawing to reduce clutter in the drawing as a whole.

DETAILED DESCRIPTION OF THE INVENTION

Figure 4B:
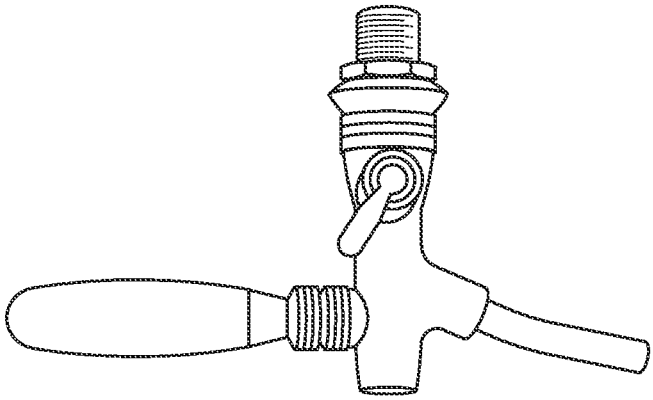
FIG. 4B (PRIOR ART)
FIG. 4 includes FIGS. 4A and 4B, which show examples of typical beverage taps that are known in the art.
Figure 4A:
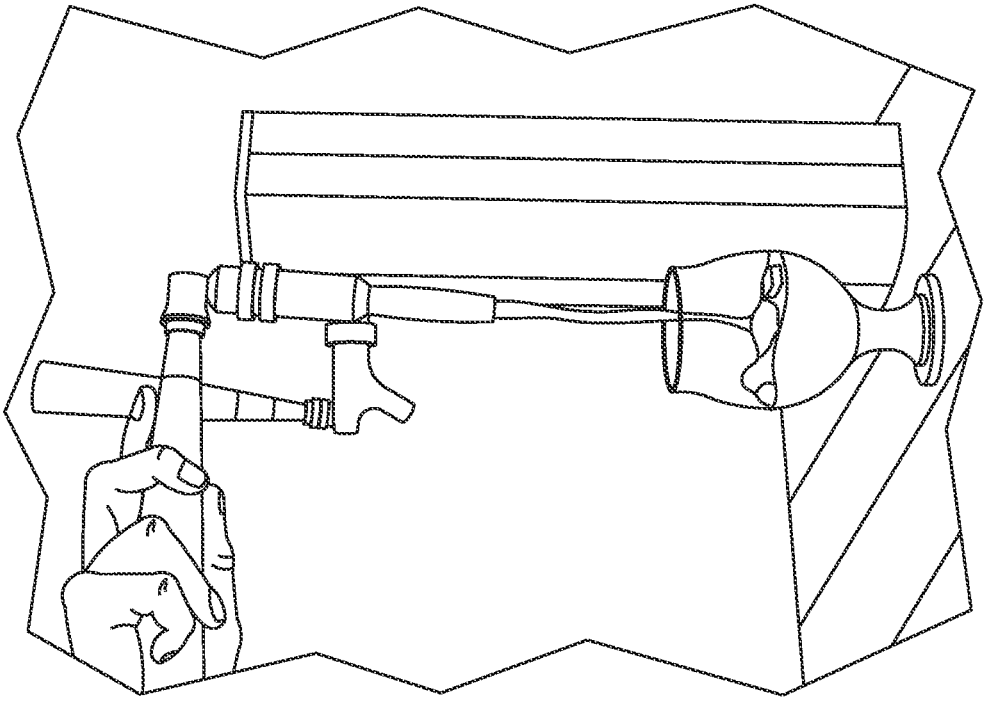
FIG. 4A (PRIOR ART)

In general, the present invention may include, or take the form of, an integrated dispense valve with gas infusion system, e.g., which operates by infusing gas into a liquid or beverage to a desired amount or gasification characteristic level. Examples of descriptive gasification levels include fizzy, foamy, gassy, bubbly, carbonation, volumes of carbonation, nitrogenated, foam head or height, etc.

FIG. 5 shows a dispense valve device block diagram, e.g., according to some embodiments of the present invention. The integrated infusion device shown therein consists of 4 essential elements:

1) Inlet Manifold (A),
2) Mixing Chamber (B),
3) Valve (C), and
4) Nozzle (D).

In FIG. 5, the mixing chamber (B) may be configured with an infuser configured to mix the gas stream, the liquid stream and the concentrate stream, consistent with that set forth herein. By way of example, the infuser may include, or take the form of, either a gas/liquid mixing chamber like element 12 shown FIG. 6, or the infuser like element 5 shown in FIG. 7, e.g., consistent with that disclosed herein. In FIG. 5, the inlet manifold (A) and the mixing chamber (B) are both configured within the integrated infusion device in close physical proximity to one another, e.g., including where the mixing chamber (B) includes a mixing chamber housing (B1) configured to receive the infuser therein. As one skilled in the art would appreciate, pressure and flow characteristics of incoming streams determine the degree of absorption of the gas stream into the liquid stream at a given temperature, pressure and flow condition.

The Inlet Manifold (A)

The beverage product and gas lines are independently fed to the inlet manifold (A) from their storage location, e.g., which may include a backroom storage area like that shown in FIGS. 3A and 3B. The inlet manifold (A) functions to provide a connection for the liquid and gas inlet product hose or conduit and to route the incoming product stream into the mixing chamber (B). The pressure and flow of the incoming streams provided to the integrated infusion device vary by application. For typical beverage soft drink carbonation applications, the water is provided from the restaurant or store's commercial building water system. For beer, coffee, teas and other beverages, the incoming liquid may be provided from a keg or other pressurized vessel, a bag-in-box, a non-pressurized cask, a bucket, or any other liquid containing vessel in pre-mix or concentrated form. The gas input is a regulated and adjustable supply provided by gas storage cylinders, pressurized vessels, nitrogen generators, via properly rated tubing or hose, fittings and flow control valves. The gas may consist of 1 or more types of gas premixed in a ratio. The inlet manifold (A) may have internal valves and flow control devices and may be equipped with barbs, quick connectors, or other port options to facilitate the connection of the beverages. The inlet manifold (A) may also include a port for cleaning solution to be delivered for clean-in-place and sanitization procedures, e.g., see the clean-in-place inlet port 24 (FIG. 6) and the description thereof below.

The inlet manifold (A) may also have integral flow and pressure capability or fluid communication ports that can be monitored by an electronic control system for the purpose of controlling the pressure and flow of the incoming streams, e.g., consistent with that disclosed in relation to FIG. 7. The inlet manifold (A) may be directly or indirectly sensing the pressure and communicating the feedback through various types of process signal communication values and methods, e.g., consistent with that disclosed in relation to FIG. 7. The inlet manifold (A) may include flow control valves, e.g., like check valves 20 (FIG. 6) to regulate or independently control the flow of the various input streams.

The gas and fluid is then introduced from the inlet manifold (A) into the mixing chamber (B).

The Mixing Chamber (B)

The mixing chamber (B) functions and is configured to mix the gas and liquid streams for the end result of infusing the gas into the liquid phase. The pressure and flow characteristics of the incoming streams determine the degree of absorption of gas into the liquid at a given temperature, pressure, and flow condition. The mixing chamber (B) is optimally designed to create an effective infusion of the beverage. The mixing chamber (B) includes a mixing chamber housing (B1) configured with an inner housing chamber to receive a gas liquid absorption device (GLAD), e.g. consistent with that shown in FIG. 6. The mixing chamber (B) and its associated mixing functionality will be described in further detail in relation to FIGS. 6 and 7 below.

The output of the mixing chamber (C) is at least partly controlled by the dispensing valve (C).

The Dispensing Valve (C)

The dispensing valve (C) functions and is configured to control the flow of the fluid mixture exiting the mixing chamber (B). The dispensing valve (C) may include both on/off and flow regulating capability. The dispensing valve (C) may be directly or indirectly controlled by a handle H, or an electronic solenoid. The fluid mixture is then routed into the dispensing nozzle (D).

The Dispensing Nozzle (D)

The nozzle (D) functions and is configured to direct the flow from the dispensing valve (C) to a cup or container for receiving the beverage. The nozzle (D) may include internal design features that create the optimum flow condition from the exit of the valve (C) into the cup for the ideal pour without excessive outgassing, turbulence, etc. The design of the nozzle (D) can greatly influence critical drink quality characteristics, such as foam quality, bubble size and coarseness, creaminess, and infusion levels.

FIG. 6: Gas Liquid Absorption Device (GLAD)

FIG. 6 shows a gas liquid absorption device (GLAD) generally indicated as 10. The GLAD 10 may include a gas/liquid mixing chamber 12, a gas inlet port 14, a premixed liquid inlet port 16, and a gas/liquid infused outlet port, part of which is indicated by reference label 18. In operation, the gas/liquid mixing chamber 12 may be configured to receive gas from the gas inlet port 14, a premixed liquid from the premixed liquid inlet port 16, and provide a gas/liquid infusion from the gas/liquid infused outlet port 18.

By way of example, the mixing chamber housing (B1) of the mixing chamber (B) may be configured to receive at least part of the GLAD 10, e.g., including receiving and containing the gas/liquid mixing chamber 12 and associated gas and liquid ports 14, 16, 18. As one skilled in the art would appreciate and understand, the mixing chamber housing (B1) may be suitably configured or adapted to receive the gas/liquid mixing chamber 12, as well as the associated gas and liquid ports 14, 16, 18 of the GLAD 10 without undue experimentation. Embodiments are envisioned, and the scope of the invention is intended to include, implementing, configuring or adapting other types or kinds of mixing chamber housing either now known or later developed in the future, e.g., to receive and contain at least part of the GLAD 10, including receiving the gas/liquid mixing chamber 12 and associated gas and liquid ports 14, 16, 18.

The GLAD 10 may also include a check valve assembly, e.g., having three check valves 20, a pressure relief valve assembly 22 and a clean-in-place inlet port 24. The three check valves 20 are arranged in relation to the gas inlet port 14 and the clean-in-place inlet port 24 in order to control the liquid flow into the GLAD 10. The clean-in-place inlet port 24 may be configured to allow the provisioning of cleaning liquids into the GLAD 10 to clean the system.

As one skilled in the art would appreciate, gas/liquid mixing chambers like element 12 are known in the art, and the scope of the invention is not intended to be limited to any particular type or kind thereof either now known or later developed in the future. For example, see U.S. Pat. No. 9,033,315 B2, which discloses a carbonation chamber in FIGS. 1-2 thereof that may be configured in a mixing chamber like element 12 to carbonate a liquid and a gas.

FIG. 7

By way of example, FIG. 7 shows an example of a gas liquid infusion system with adjustable absorption level, e.g., having an infuser that may be configured in, or form part of, the integrated infusion device, according to the present invention.

The gas liquid infusion system may include components, as follows:

a motor driven pump 1, an optional fluid sensing device (P2), an optional gas pressure sensing device (P1) 3 an electronic control logic subsystem 4 and an infuser 5 (aka, a gas liquid absorption device, a mixing valve, a carbonator, a nitrogenator, a mixing vessel).

The motor driven pump 1 may be configured to receive control signaling from the electronic control logic subsystem 4, e.g., including output signals that are output to control external devices, valves, etc., receive incoming liquid pressure, e.g., from a commercial water supply, a tank, or a pressurized vessel, and provide pumped liquid to the infuser 5.

The fluid sensing device 2 (P2) may be configured to sense the pressure of the pumped liquid to the infuser 5, sense the pressure of a gas infused liquid provided from the infuser 5 to a dispensing system or valve (e.g., like element C (FIG. 5)), and provide P2 fluid sensing signals as pressure input signals for the electronic control logic subsystem 4.

The gas pressure sensing device 3 (P1) may be configured to sense a gas input pressure of a pressure regulated gas provided to the infuser 5, and provide P1 gas pressure sensing signals as further pressure input signals for the electronic control logic subsystem 4.

The electronic control logic subsystem 4 may be configured to receive input signals, the pressure input signals, and provide the control signaling and the output signals to control the operation of the motor driven pump 1 in relation to the infuser 5. By way of example, the input signals may include user defined parameters for operating the gas liquid infusion system with the adjustable absorption level.

The infuser 5 may be configured to receive the pumped liquid from the motor driven pump 1 and the pressure regulated gas, e.g., typically from a CO2 or nitrogen source (e.g., having 0-100 PSI), and provide the gas infused liquid to the dispensing system or valve (e.g., like element C (FIG. 5)).

Implementation of the Electronic Control Logic Subsystem 4

By way of example, the electronic control logic subsystem 4, according to some embodiments of the present invention, e.g., may be implemented using a signal processor or processing module configured at least to receive the signaling sensed and mentioned herein, and provide corresponding control signaling to operate the motor driven pump 1.

By way of example, the functionality of the signal processor or processing module 100*a* may be implemented using hardware, software, firmware, or a combination thereof. In a typical software implementation, a signal processor may include one or more microprocessor-based architectures, e. g., having at least one signal processor or microprocessor. One skilled in the art would be able to program with suitable program code such a microcontroller-based, or microprocessor-based, implementation to perform the signal processing functionality disclosed herein without undue experimentation.

The scope of the invention is not intended to be limited to any particular implementation using technology either now known or later developed in the future. The scope of the invention is intended to include implementing the functionality of the signal processor(s) as stand-alone processor, signal processor, or signal processor module, as well as separate processor or processor modules, as well as some combination thereof.

By way of example, the electronic control logic subsystem 4 may also include, e.g., other signal processor circuits or components, including random access memory or memory module (RAM) and/or read only memory (ROM), input/output devices and control, and data and address buses connecting the same, and/or at least one input processor and at least one output processor, e.g., which would be appreciate by one skilled in the art.

By way of further example, the signal processor may include, or take the form of, some combination of a signal processor and at least one memory including a computer program code, where the signal processor and at least one memory are configured to cause the system to implement the functionality of the present invention, e.g., to respond to signaling received and to determine the corresponding control signaling, based upon the signaling received.

By way of example, FIG. 8 shows a REV OEM controller for a gas/liquid infusion system, according to some embodiments of the present invention. The OEM controller shown in FIG. 8 may be used, and/or suitable adapted and used, e.g., to implement the electronic control logic subsystem 4 shown in FIG. 7.

The Infuser 5

Consistent with that set forth above, and by way of further example, the infuser 5 in FIG. 7 may include, or take the form of at least in part, the carbonation chamber disclosed in relation to FIGS. 1-2 of U.S. Pat. No. 9,033,315 B2, as well as other types or kinds of mixing valves, carbonators, nitrogenator, mixing vessel either now known or later developed in the future within the spirit of the present invention.

Liquid and Gas Pressure Sensors and Other Devices

Liquid and gas pressure sensors like elements 2 and 3 are known in the art, and the scope of the invention is not intended to be limited to any particular type or kind thereof either now known or later developed in the future.

Motor driven pumps, infusion tank/vessels, etc. are also known in the art, and the scope of the invention is not intended to be limited to any particular type or kind thereof either now known or later developed in the future.

FIG. 9

FIG. 9 shows an example of a REV OEM controller wiring diagram for the gas/liquid infusion system, according to some embodiments of the present invention. The OEM controller wiring shown in FIG. 9 may be used, and/or suitable adapted and used, e.g., to implement the controller wiring in relation to the components 1 thru 5, and P1 and P2 in FIG. 7.

Possible Applications

Possible applications include the following:

1. Infusing CO2 or other Gases such as Nitrogen into liquids for beverages Water, Soda, Beer, Coffee, Tea, Milk and Yogurt Based.
2. Infusing CO2 or other Gases such as Nitrogen into liquids for increasing the effectiveness of cleaning, sanitizing, etc. for example General Surface Cleaning, Soil extraction, Beverage Line Cleaning, Water Purification.

THE SCOPE OF THE INVENTION

The embodiments shown and described in detail herein are provided by way of example only; and the scope of the invention is not intended to be limited to the particular configurations, dimensionalities, and/or design details of these parts or elements included herein. In other words, one skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein and thereto without departing from the spirit and scope of the present invention.

What we claim is:

1. A dispense tap with integral gas/liquid infusion for dispensing a beverage at a given dispensing point inside a restaurant, a coffee shop, a bar, or a convenience store, comprising:

a mixing chamber having at least one gas input port configured to receive at least one incoming gas stream;

at least one liquid input port configured to receive at least one incoming liquid or concentrate stream; and an infuser configured to mix the at least one incoming gas stream and the at least one incoming liquid or concentrate stream at the given dispensing point within the dispensing tap, and provide a mixing chamber stream containing a gas infused liquid mixture of the at least one incoming gas stream and the at least one incoming liquid or concentrate stream for dispensing as a beverage, where the degree of absorption of the at least one incoming gas stream and the at least one incoming liquid or concentrate stream in the gas infused liquid mixture depends at least in part on sensed gas, liquid or concentrate pressure characteristics of one or more of the at least one incoming gas stream received by the infuser, the at least one incoming liquid or concentrate stream received by the infuser, or the gas infused liquid mixture provided from the infuser; and an inlet manifold having;

a nitrogen gas inlet line configured to receive a nitrogen gas stream;

a liquid inlet line configured to receive a liquid stream;

a concentrate inlet line configured to receive a concentrate stream; and a CO2 gas inlet line configured to receive a CO2 gas stream.

2. A dispense tap according to claim 1, wherein the degree of absorption of the at least one incoming gas stream and the at least one incoming liquid or concentrate stream in the gas infused liquid mixture depends at least in part on the sensed gas, liquid or concentrate pressure characteristics of two or more of the at least one incoming gas stream received by the infuser, the at least one incoming liquid or concentrate stream received by the infuser, or the gas infused liquid mixture provided from the infuser.

3. A dispense tap according to claim 1, wherein the degree of absorption of the at least one incoming gas stream and the at least one incoming liquid or concentrate stream in the gas infused liquid mixture depends on the sensed gas, liquid or concentrate pressure characteristics of all of the at least one incoming gas stream received by the infuser, the at least one incoming liquid or concentrate stream received by the infuser, and the gas infused liquid mixture provided from the infuser.

4. A dispense tap according to claim 1, wherein the dispense tap forms part of a gas liquid infusion system with an adjustable absorption level output having gas and liquid pressure sensors, an electronic control logic subsystem and a motor driven pump;

the gas and liquid pressure sensors are configured to respond to gas, liquid or concentrate pressures of the one or more of the at least one incoming gas stream, the at least one incoming liquid or concentrate stream, and the gas infused liquid mixture, and provide gas, liquid or concentrate pressure sensor signals containing information about the gas, liquid or concentrate pressures sensed;

the electronic control logic subsystem is configured to respond to the gas, liquid or concentrate pressure sensor signals, and provide pump control signals; and the motor driven pump is configured to respond to the pump control signals, and pump the at least one incoming liquid or concentrate stream, based upon the pump control signals received.

5. A dispense tap according to claim 1, wherein the dispense tap comprises an inlet manifold having:

at least one gas inlet line configured to receive the at least one incoming gas stream and provide the at least one incoming gas stream to the at least one gas input port; and at least one liquid inlet line configured to receive the at least one incoming liquid or concentrate stream and provide the at least one incoming liquid or concentrate stream to the at least one liquid input port.

6. A dispense tap according to claim 5, wherein the inlet manifold comprises gas and liquid pressure sensors configured to respond to gas and liquid pressures of the one or more of the at least one incoming gas stream, the at least one incoming liquid stream and the gas infused liquid mixture, and provide gas and liquid pressure sensor signals containing information about the gas and liquid pressures sensed.

7. A dispense tap according to claim 1, wherein the nitrogen gas inlet line is configured to provide the nitrogen gas stream to the at least one gas input port;

the liquid inlet line is configured to provide the liquid stream to the at least one liquid input port;

the concentrate inlet line is configured to provide the concentrate stream to the at least one gas input port; and the CO2 gas inlet line is configured to provide the CO2 gas stream to the to the at least one liquid input port.

8. A dispense tap according to claim 1, wherein the dispense tap comprises:

a handle or electronic solenoid configured to move between a dispense position and a closed position;

a valve configured to respond to movement of the handle or electronic solenoid from the closed position to the dispense position and provide the infused mixture from the mixing chamber; and a nozzle configured to receive the infused mixture from the valve, and dispense the infused mixture from the dispense tap.

9. A dispense tap according to claim 1, wherein the mixing chamber comprises a mixing chamber housing configured to receive and contain at least the infuser.

10. A dispense tap according to claim 1, wherein the mixing chamber comprises a mixing chamber output port configured to provide the mixing chamber stream for dispensing as the beverage.

11. A dispense tap according to claim 1, wherein the dispense tap forms part of a gas liquid absorption device having a gas/liquid mixing chamber with the infuser.

12. A dispense tap with integral gas/liquid infusion for dispensing a beverage at a given dispensing point inside a restaurant, a coffee shop, a bar, or a convenience store, comprising:

a mixing chamber having at least one gas input port configured to receive at least one incoming gas stream, the at least one gas input port having a CO2 port configured to receive a CO2 gas stream, and a nitrogen input port configured to receive a nitrogen gas stream;

at least one liquid input port configured to receive at least one incoming liquid or concentrate stream; and an infuser configured to mix the at least one incoming gas stream and the at least one incoming liquid or concentrate stream at the given dispensing point within the dispensing tap, and provide a mixing chamber stream containing a gas infused liquid mixture of the at least one incoming gas stream and the at least one incoming liquid or concentrate stream for dispensing as a beverage, where the degree of absorption of the at least one incoming gas stream and the at least one incoming liquid or concentrate stream in the gas infused liquid mixture depends at least in part on sensed gas, liquid or concentrate pressure characteristics of one or more of the at least one incoming gas stream received by the infuser, the at least one incoming liquid or concentrate stream received by the infuser, or the gas infused liquid mixture provided from the infuser.

13. A dispense tap with integral gas/liquid infusion for dispensing a beverage at a given dispensing point inside a restaurant, a coffee shop, a bar, or a convenience store, comprising:

a mixing chamber having at least one gas input port configured to receive at least one incoming gas stream;

at least one liquid input port configured to receive at least one incoming liquid or concentrate stream, the at least one liquid input port having a liquid input port configured to receive a liquid stream and a concentrate input port configured to receive a concentrate stream; and an infuser configured to mix the at least one incoming gas stream and the at least one incoming liquid or concentrate stream at the given dispensing point within the dispensing tap, and provide a mixing chamber stream containing a gas infused liquid mixture of the at least one incoming gas stream and the at least one incoming liquid or concentrate stream for dispensing as a beverage, where the degree of absorption of the at least one incoming gas stream and the at least one incoming liquid or concentrate stream in the gas infused liquid mixture depends at least in part on sensed gas, liquid or concentrate pressure characteristics of one or more of the at least one incoming gas stream received by the infuser, the at least one incoming liquid or concentrate stream received by the infuser, or the gas infused liquid mixture provided from the infuser.

14. A gas liquid infusion system, comprising:

a dispense tap with integral infusion for dispensing a beverage at a given dispensing point inside a restaurant, a coffee shop, a bar, or a convenience store, having a mixing chamber that includes:

at least one gas input port configured to receive at least one incoming gas stream;

at least one liquid input port configured to receive at least one incoming liquid or concentrate stream; and an infuser configured to mix the at least one incoming gas stream and the at least one incoming liquid or concentrate stream at the given dispensing point within the dispensing tap, and provide a mixing chamber stream containing a gas infused liquid mixture of the at least one incoming gas stream and the at least one incoming liquid or concentrate stream for dispensing as a beverage, where the degree of absorption of the at least one incoming gas stream and the at least one incoming liquid or concentrate stream in the gas infused liquid mixture depends at least in part on sensed gas, liquid or concentrate pressure characteristics of one or more of the at least one incoming gas stream received by the infuser, the at least one incoming liquid or concentrate stream received by the infuser, or the gas infused liquid mixture provided from the infuser; and gas and liquid pressure sensors, are electronic control logic subsystem and a motor driven pump configured to provide an adjustable absorption level output;

the gas and liquid pressure sensors being configured to respond to the gas, liquid or concentrate pressures of one or more of the at least one incoming gas stream, the at least one incoming liquid or concentrate stream and the gas infused liquid mixture, and provide gas, liquid or concentrate pressure sensor signals containing information about the gas, liquid or concentrate pressures senses;

the electronic control logic subsystem being configured to respond to the gas, liquid or concentrate pressure sensor signals, and provide pump control signals; and the motor driven pump being configured to respond to the pump control signals, and pump the at least one incoming liquid or concentrate stream, based upon the pump control signals received; and an inlet manifold having:

a nitrogen gas inlet line configured to receive a nitrogen gas stream;

a liquid inlet line configured to receive a liquid stream;

a concentrate inlet line configured to receive a concentrate stream; and a CO2 gas inlet line configured to receive a CO2 gas stream.

15. A dispense tap according to claim 14, wherein the nitrogen gas inlet line is configured to provide the nitrogen gas stream to the at least one gas input port;

the liquid inlet line is configured to provide the liquid stream to the at least one liquid input port;

the concentrate inlet line is configured to provide the concentrate stream to the at least one gas input port; and the CO2 gas inlet line is configured to provide the CO2 gas stream to the to the at least one liquid input port.

16. A gas liquid infusion system according to claim 15, wherein the inlet manifold includes the gas and liquid pressure sensors that are configured to sense the gas and liquid pressures of gas, liquid and concentrate streams provided to the infuser.

17. A gas liquid infusion system according to claim 14, wherein the dispense tap comprises:

a handle or electronic solenoid configured to move between a dispense position and a closed position;

a valve configured to respond to movement of the handle or electronic solenoid from the closed position to the dispense position and provide the infused mixture from the mixing chamber; and a nozzle configured to receive the infused mixture from the valve, and dispense the infused mixture from the dispense tap.

* * * * *